US010894238B2

(12) United States Patent
Singh et al.

(10) Patent No.: US 10,894,238 B2
(45) Date of Patent: Jan. 19, 2021

(54) ADHESIVE AND SEALANT MIXERS WITH AUTOMATIC STROKE LENGTH ADJUSTMENT

(71) Applicant: PRC-DeSoto International, Inc., Sylmar, CA (US)

(72) Inventors: Goldi Singh, Chino Hills, CA (US); Paul Kuchinski, Burbank, CA (US)

(73) Assignee: PRC-DeSoto International, Inc., Cleveland, OH (US)

( * ) Notice: Subject to any disclaimer, the term of this patent is extended or adjusted under 35 U.S.C. 154(b) by 324 days.

(21) Appl. No.: 15/939,713

(22) Filed: Mar. 29, 2018

(65) Prior Publication Data

US 2019/0299174 A1 Oct. 3, 2019

(51) Int. Cl.
*B01F 7/16* (2006.01)
*B01F 11/00* (2006.01)
(Continued)

(52) U.S. Cl.
CPC ..... *B01F 7/161* (2013.01); *B01F 7/00725* (2013.01); *B01F 11/0071* (2013.01); *B01F 13/003* (2013.01); *B01F 13/0023* (2013.01); *B01F 15/00331* (2013.01); *B01F 15/00467* (2013.01); *B01F 15/00733* (2013.01); *F15B 15/1476* (2013.01); *F15B 15/28* (2013.01); *B01F 7/22* (2013.01);
(Continued)

(58) Field of Classification Search
CPC ..... B01F 11/0054; B01F 11/0071; B01F 13/0023; B01F 13/003; B01F 15/00331; B01F 15/00733; B01F 2215/006; B01F 7/1655; B01F 7/22; B01F 7/161; B01F 15/00467; B01F 7/00725
See application file for complete search history.

(56) References Cited

U.S. PATENT DOCUMENTS 2,859,017 A * 11/1958 Trumbull ..... B01F 11/0082 366/256
RE28,275 E * 12/1974 Friendship ..... B67C 3/2617 141/6
(Continued)

FOREIGN PATENT DOCUMENTS

DE 29708716 U1 * 8/1997 ..... B05C 17/015
DE 29708716 10/1997
(Continued)

OTHER PUBLICATIONS

Semco® 1188 Instruction Manual, PPG Industries, © 2015, CBM, Inc. 14 pages.
(Continued)

*Primary Examiner* — Tony G Soohoo
(74) *Attorney, Agent, or Firm* — Alan G. Towner

(57) ABSTRACT

Mixers for adhesives and sealants that include automatic stroke length adjustment for different sizes and configurations of adhesive and sealant cartridges are disclosed. The mixers include a sensor for detecting when a mixing impeller reaches the top of a cartridge and the bottom of a cartridge, which sends a signal to a main pressure cylinder to reverse direction. The stroke length of the mixer is automatically adjusted without the necessity of manual selection based upon a particular cartridge size.

15 Claims, 8 Drawing Sheets

(51) Int. Cl.

| | |
|---|---|
| ***B01F 15/00*** | (2006.01) |
| ***F15B 15/28*** | (2006.01) |
| ***B01F 13/00*** | (2006.01) |
| ***F15B 15/14*** | (2006.01) |
| ***B01F 7/00*** | (2006.01) |
| ***B01F 7/22*** | (2006.01) |

(52) U.S. Cl.
CPC . *B01F 2215/006* (2013.01); *F15B 2211/6336* (2013.01); *F15B 2211/7053* (2013.01); *F15B 2211/7725* (2013.01)

(56) References Cited

U.S. PATENT DOCUMENTS

| | | | | |
|---|---|---|---|---|
| 4,043,198 | A | 8/1977 | Stillwell et al. | |
| 4,406,303 | A | 9/1983 | Kilmoyer | |
| 4,804,913 | A * | 2/1989 | Shimizu | F15B 15/28 324/207.23 |
| 4,889,432 | A * | 12/1989 | Patterson | A61C 9/0026 366/139 |
| 5,050,634 | A | 9/1991 | Fiechtner | |
| 5,145,250 | A * | 9/1992 | Planck | B01F 7/161 366/139 |
| 5,361,881 | A | 11/1994 | Simond | |
| 5,691,894 | A * | 11/1997 | Fukushima | F15B 15/262 700/28 |
| 6,213,631 | B1 * | 4/2001 | Miranda | B01F 7/1695 366/130 |
| 6,485,171 | B1 | 11/2002 | Wang et al. | |
| 6,799,614 | B1 | 10/2004 | Smith et al. | |
| 6,910,799 | B2 * | 6/2005 | Renfro | B01F 7/1695 366/169.1 |
| 7,070,318 | B2 * | 7/2006 | Renfro | B01F 7/1695 366/143 |
| 7,407,321 | B1 * | 8/2008 | Renfro | B01F 7/1695 366/251 |
| 7,711,509 | B2 | 5/2010 | Woodard et al. | |
| 7,963,717 | B2 | 6/2011 | Seger | |
| 7,980,755 | B2 * | 7/2011 | Renfro | B01F 7/1695 366/255 |
| 8,342,086 | B2 * | 1/2013 | Resch | F15B 7/006 100/269.14 |
| 2003/0099153 | A1 | 5/2003 | Renfro | |
| 2008/0068922 | A1 * | 3/2008 | Voss | B01F 15/00857 366/134 |
| 2008/0291774 | A1 * | 11/2008 | Voss | B01F 7/00808 366/151.2 |
| 2009/0161480 | A1 * | 6/2009 | Voss | B01F 7/00808 366/132 |
| 2011/0265805 | A1 | 11/2011 | Laplante | |
| 2013/0070554 | A1 | 3/2013 | Voss | |
| 2019/0299174 | A1 * | 10/2019 | Singh | B01F 13/0023 |

FOREIGN PATENT DOCUMENTS

| | | | | |
|---|---|---|---|---|
| DE | 202005005150 | | 7/2005 | |
| DE | 202018104763 | U1 * | 9/2018 | B01F 15/00746 |
| DE | 202018104769 | U1 * | 9/2018 | B01F 15/00772 |
| EP | 1994977 | | 11/2008 | |
| FR | 2630661 | | 11/1989 | |
| JP | S469660 | | 7/1974 | |
| WO | WO-2019186446 | A1 * | 10/2019 | B01F 7/1655 |
| WO | WO-2020038525 | A1 * | 2/2020 | B01F 7/00725 |

OTHER PUBLICATIONS

Maschinefabrik Heinrich Meyer Walsrode, Operating Instructions for MC Injection Mixer, No. 42008-6, 29 pages.

* cited by examiner

ADHESIVE AND SEALANT MIXERS WITH AUTOMATIC STROKE LENGTH ADJUSTMENT

FIELD OF THE INVENTION

The present invention relates to mixers for adhesives and sealants, and more particularly relates to mixers with automatic stroke length adjustment for different sizes and configurations of adhesive and sealant cartridges.

BACKGROUND OF THE INVENTION

Conventional adhesive and sealant mixers, such as those utilized in the aerospace industry are used to mix separate components together in a cartridge. The cartridges are mounted on a reciprocating platform, and a rotating dasher rod with an impeller is forced through the inside of the cartridge to thereby mix the adhesive or sealant components together. The cartridges come in different sizes and configurations, and an operator manually configures the mixer based on the particular cartridge that is mounted thereon. The stroke length may thus be changed by manual selection of a particular cartridge size in order to switch directions of the rotating dasher rod when the mixing impeller reaches the top and bottom of the cartridge. This creates an issue for the control of production processes, because it allows for operator error in that the required inputs could cause improper mixing. Also, there can be a perception of the mixer malfunctioning when the proper size is not selected, machine setup and the adhesive or sealant inside the cartridge does not appear homogenous in appearance.

SUMMARY OF THE INVENTION

An aspect of the invention provides a mixer for adhesives or sealants comprising a cartridge support plate; a cartridge holder sleeve mounted on the cartridge support plate structured and arranged to receive at least a portion of an adhesive or sealant cartridge therein; a pressure sensitive housing mounted on the cartridge support plate; a piston reciprocatingly movable within the pressure sensitive housing defining an upper piston chamber and a lower piston chamber within the pressure sensitive housing; an upper biasing element in the upper piston chamber; a lower biasing element in the lower piston chamber; at least one proximity sensor mounted on the pressure sensitive housing structured and arranged to sense a position of the piston within the pressure sensitive housing; a piston rod connected to the piston and extendable from the pressure sensitive housing; and a main pressure cylinder comprising a reciprocating rod extendable therefrom connected to the piston rod, wherein upward movement of the reciprocating rod causes the piston to move toward an upper end wall of the upper piston chamber against force applied to the piston by the upper biasing element, and downward movement of the reciprocating rod causes the piston to move toward a lower end wall of the lower piston chamber against force applied to the piston by the lower biasing element.

Another aspect of the invention provides an adhesive or sealant mixing assembly comprising a cartridge support plate; a cartridge support plate; an adhesive sealant cartridge mounted on the cartridge support plate; a pressure sensitive housing connected to the cartridge support plate; a piston reciprocatingly movable within the pressure sensitive housing defining an upper piston chamber and a lower piston chamber within the pressure sensitive housing; an upper biasing element in the upper piston chamber; a lower biasing element in the lower piston chamber; at least one proximity sensor mounted on the pressure sensitive housing structured and arranged to sense a position of the piston within the pressure sensitive housing; a piston rod connected to the piston and extendable from the pressure sensitive housing; a main pressure cylinder comprising a reciprocating rod extendable therefrom connected to the piston rod, wherein upward movement of the reciprocating rod causes the piston to move toward an upper end wall of the upper piston chamber against force applied to the piston by the upper biasing element, and downward movement of the reciprocating rod causes the piston to move toward a lower end wall of the lower piston chamber against force applied to the piston by the lower biasing element, and wherein the adhesive or sealant cartridge comprises a lower end with a discharge opening therethrough; an upper open end; an upper plunger inserted in the cartridge through the upper open end; a rotatable dasher rod slidably extendable through the discharge opening; a mixing impeller attached to an upper end of the rotatable dasher rod; a spindle attachment disk attached to a lower end of the rotatable dasher rod; and an adhesive or sealant material at least partially filling a mixing volume inside the cartridge between the lower end and the upper plunger.

A further aspect of the invention provides a pressure sensitive housing mounted on a cartridge support plate; a piston reciprocatingly movable within the pressure sensitive housing defining an upper piston chamber and a lower piston chamber within the pressure sensitive housing; an upper biasing element in the upper piston chamber; a lower biasing element in the lower piston chamber; at least one proximity sensor mounted on the pressure sensitive housing structured and arranged to sense a position of the piston within the pressure sensitive housing; a piston rod connected to the piston and extendable from the pressure sensitive housing; and a main pressure cylinder comprising a reciprocating rod extendable therefrom connected to the piston rod, wherein upward movement of the reciprocating rod causes the piston to move toward an upper end wall of the upper piston chamber against force applied to the piston by the upper biasing element, and downward movement of the reciprocating rod causes the piston to move toward a lower end wall of the lower piston chamber against force applied to the piston by the lower biasing element.

These and other aspects of the present invention will be more apparent from the following description.

BRIEF DESCRIPTION OF THE DRAWINGS

In FIG. 4, a dasher rod and mixing impeller are located in an intermediate or middle position in relation to a cartridge containing adhesive or sealant. In FIG. 5, the dasher rod and mixing impeller are in an uppermost position inside the cartridge. In FIG. 6, the dasher rod and mixing impeller are in a lowermost position inside the cartridge.

DETAILED DESCRIPTION

Figure 1:
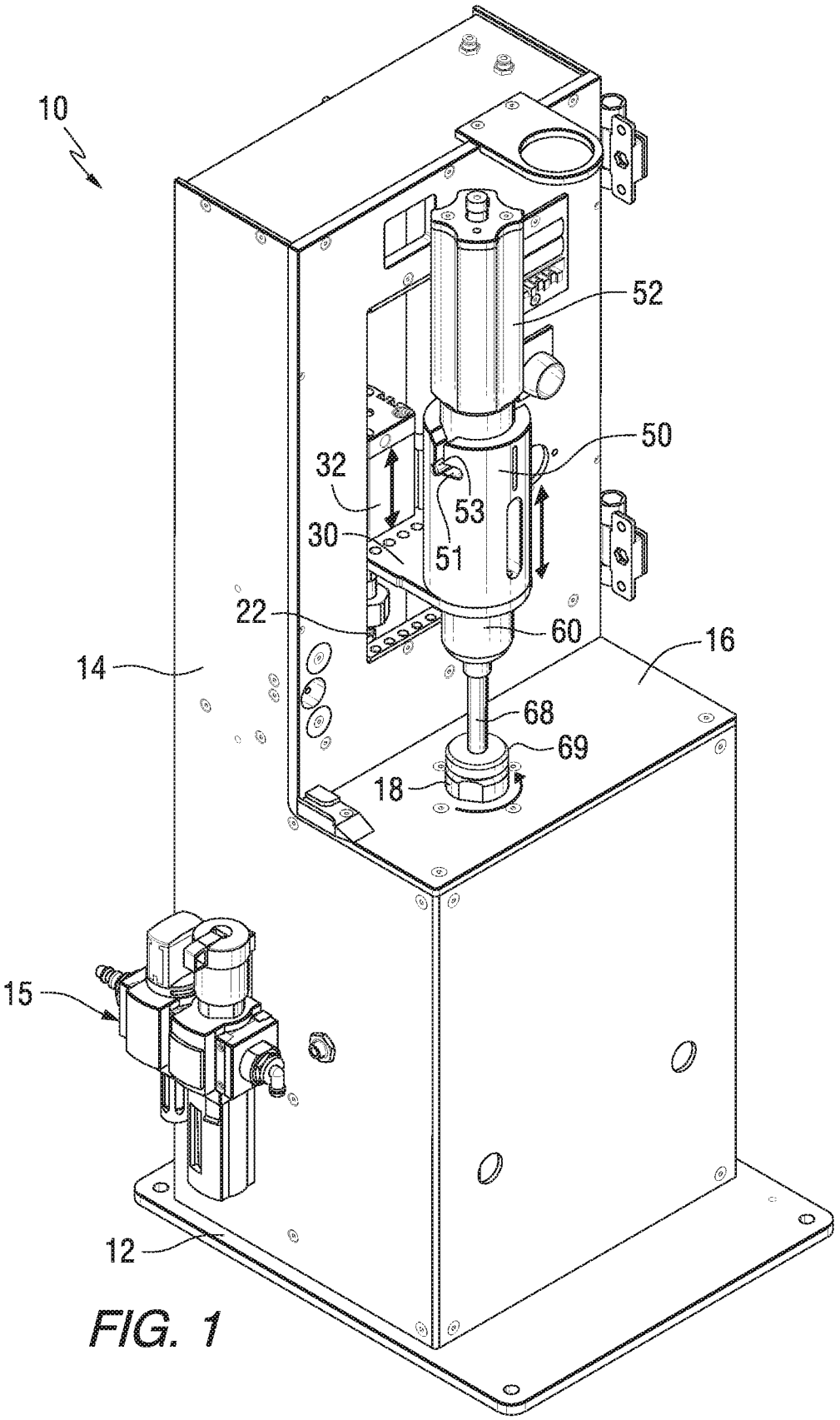
FIG. 1 is an isometric view of an adhesive and sealant mixer with automatic stroke length adjustment in accordance with an embodiment of the present invention.
Figure 2:
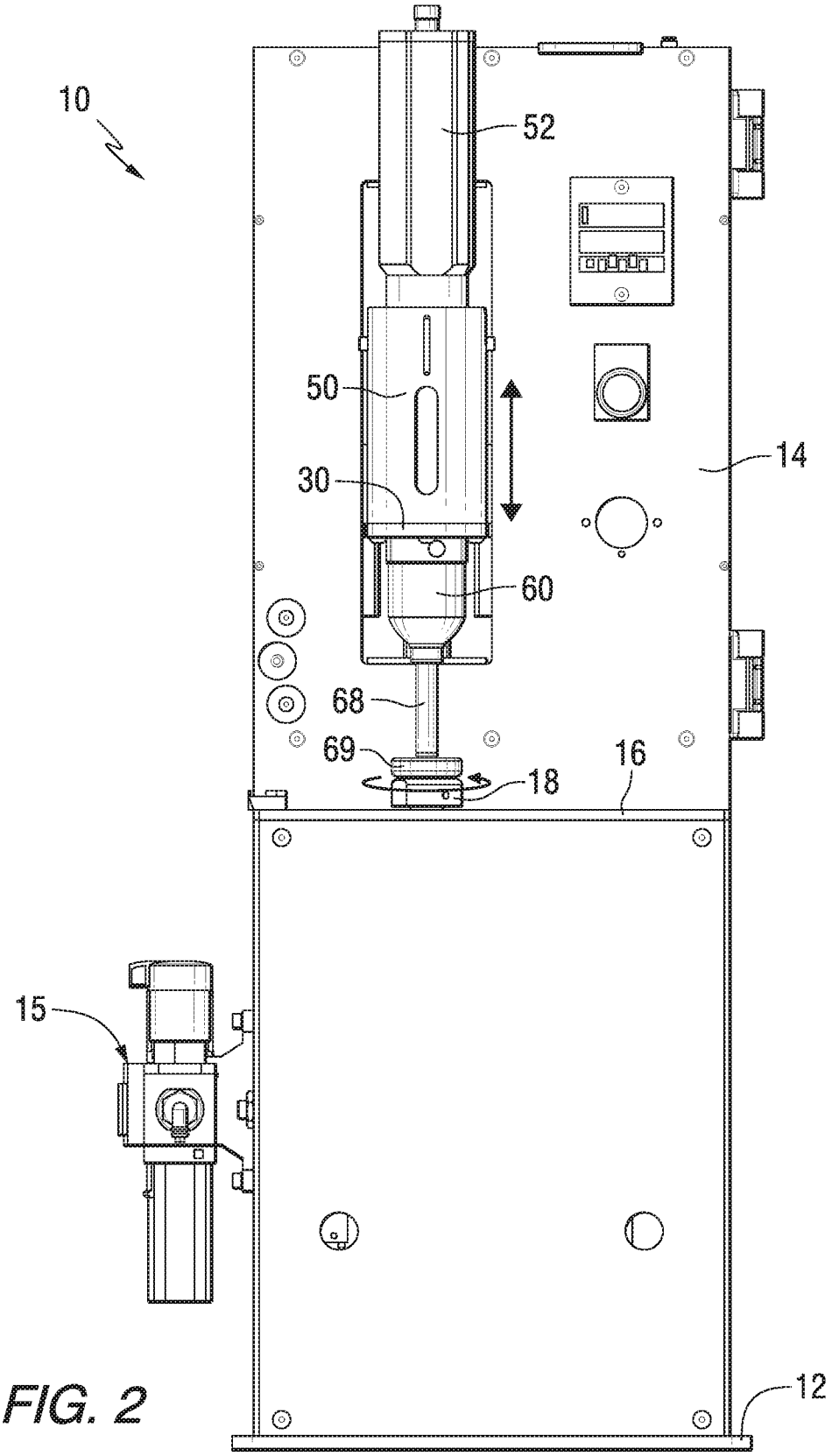
FIG. 2 is a front view of the mixer of FIG. 1.
Figure 3:
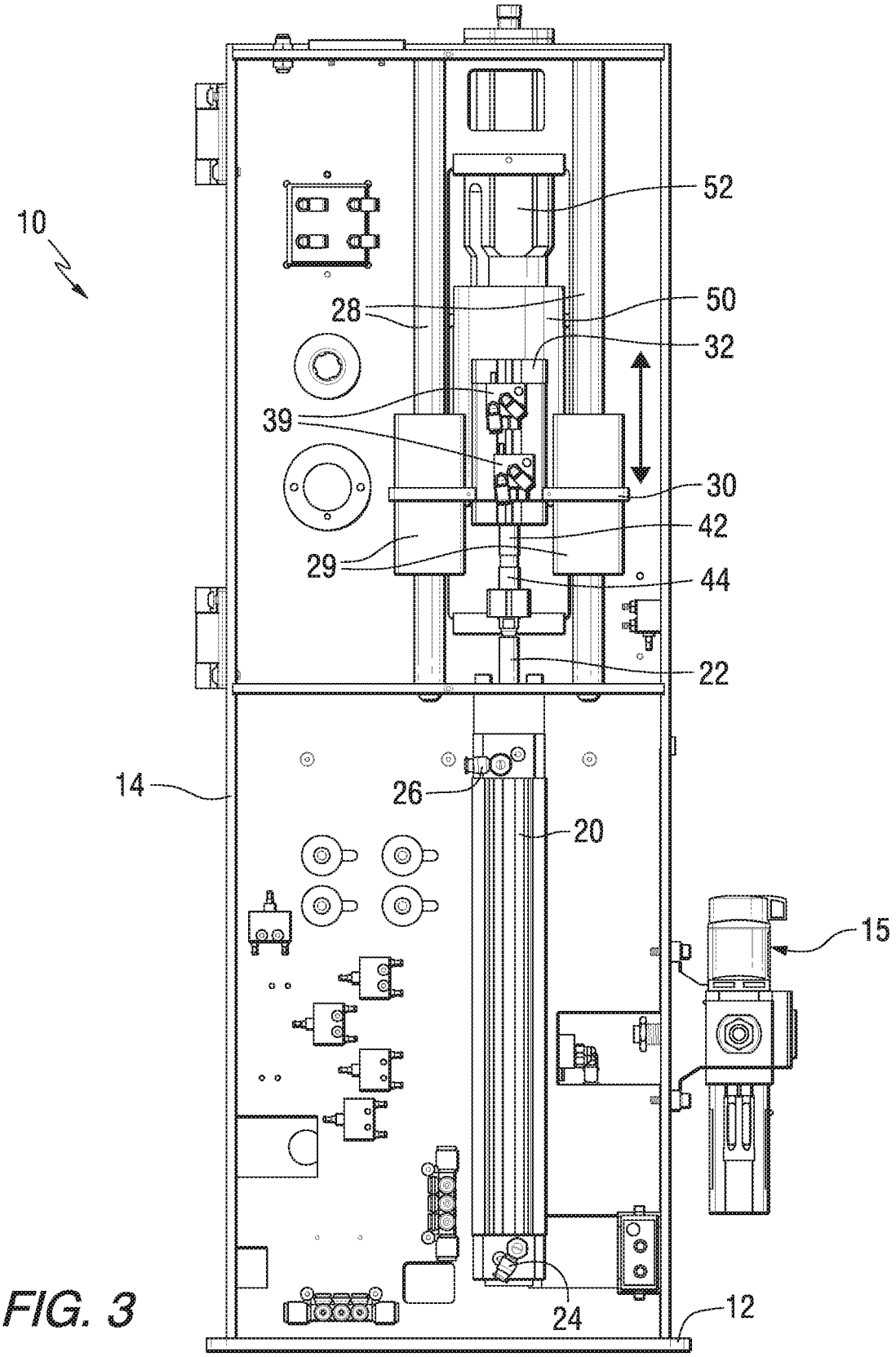
FIG. 3 is a back view of the mixer of FIG. 1.

FIGS. 1-3 illustrate an adhesive and sealant mixer 10 capable of automatically adjusting stroke height in accordance with an embodiment of the present invention is shown. The mixer 10 includes a base 12, housing 14 and platform 16. A spindle 18 is rotatably mounted on the platform 16. A pressurized air inlet assembly 15 is provided on the housing 16.

As shown most clearly in FIG. 3, the mixer 10 includes a main pressure cylinder 20 with a reciprocating rod 22 extendible therefrom. A lower pressurized air inlet 24 is provided near the bottom of the main pressure cylinder 20, and an upper pressurized air inlet 26 is provided near the top of the main pressure cylinder 20. When pressurized air is fed through the lower pressurized air inlet 24, the reciprocating rod 22 is forced upward from the main pressure cylinder 20. Conversely, when pressurized air is fed through the upper pressurized air inlet 26, the reciprocating rod 22 is forced downward into the main pressure cylinder 20. Two parallel guide rods 28 are mounted in the housing, and guide sleeves 29 are slidingly mounted on the guide rods 28. A cartridge support plate 30 is connected to the guide sleeves 29. As shown by the arrow in FIG. 3, the cartridge support plate 30 is vertically movable up and down along the guide rods 28.

As shown in FIGS. 1 and 3, a pressure sensitive housing 32 is fixedly mounted on the cartridge support plate 30. The reciprocating rod 22 extending from the main pressure cylinder 20 engages a piston rod 42 that extends into the housing 32 by means of a coupling 44. As more fully described below, the piston rod 42 is connected to a piston 40 that travels inside the pressure sensitive housing 32.

As shown in FIGS. 1-3, a cartridge holder sleeve 50 is fixedly mounted on the cartridge support plate 30, and a cartridge pusher 52 is inserted in the top of the cartridge holder sleeve 50. As shown in FIGS. 1 and 2, an adhesive or sealant cartridge 60 is held in the cartridge holder sleeve 50 with its lower end extending downward therefrom. As more fully described below, a dasher rod 68 is rotatably and slidably movable within the adhesive/sealant cartridge 60. A lower spindle attachment disk 69 is fixed to the bottom of the dasher rod 68 and engages the rotating spindle 18 on the platform 16 in order to rotate the dasher rod 68 while holding the spindle attachment disk 69 securely to the spindle 18.

Figure 4:
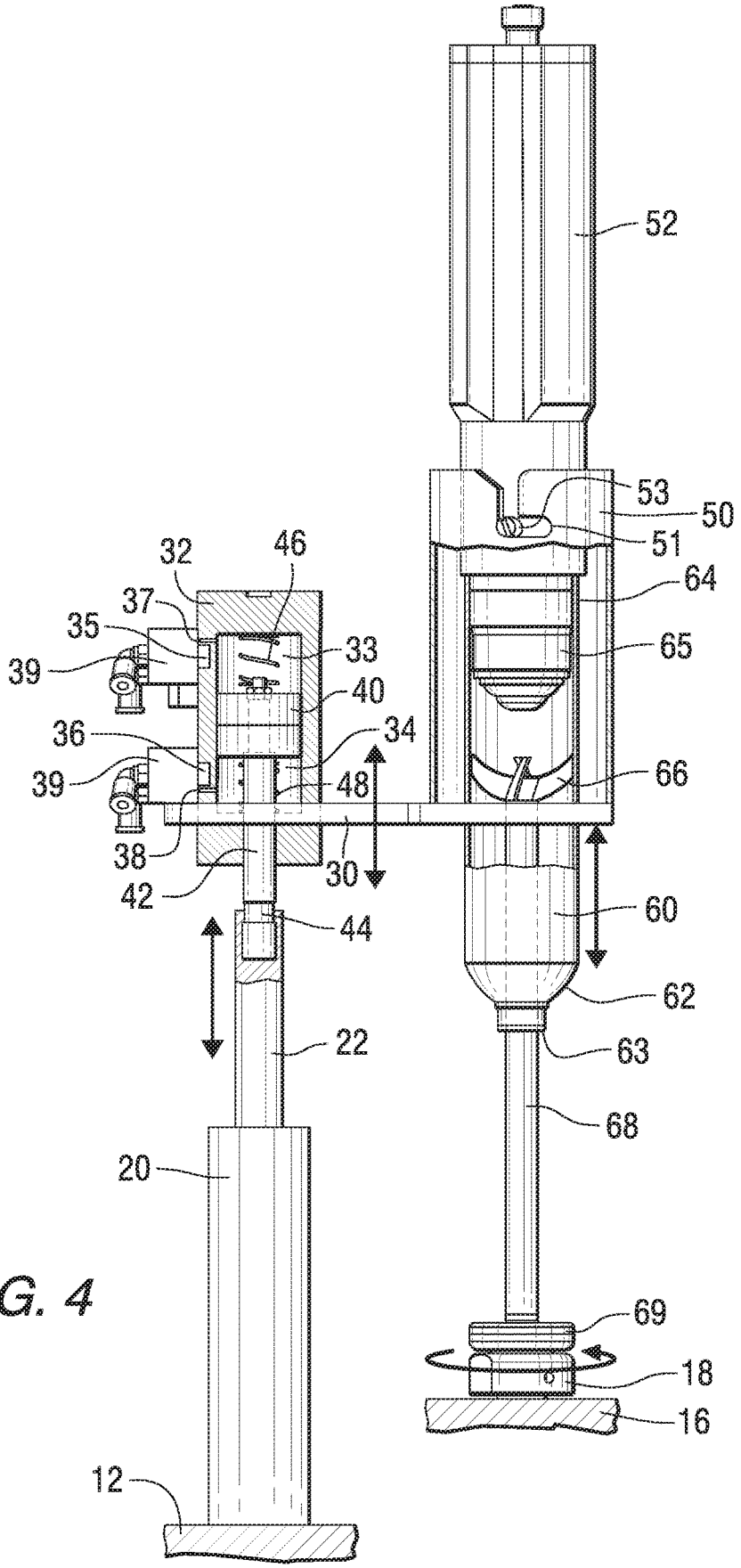
FIGS. 4-6 are partially schematic side views of components for automatically adjusting stroke length during use of an adhesive and sealant mixer in accordance with an embodiment of the present invention.
Figure 5:
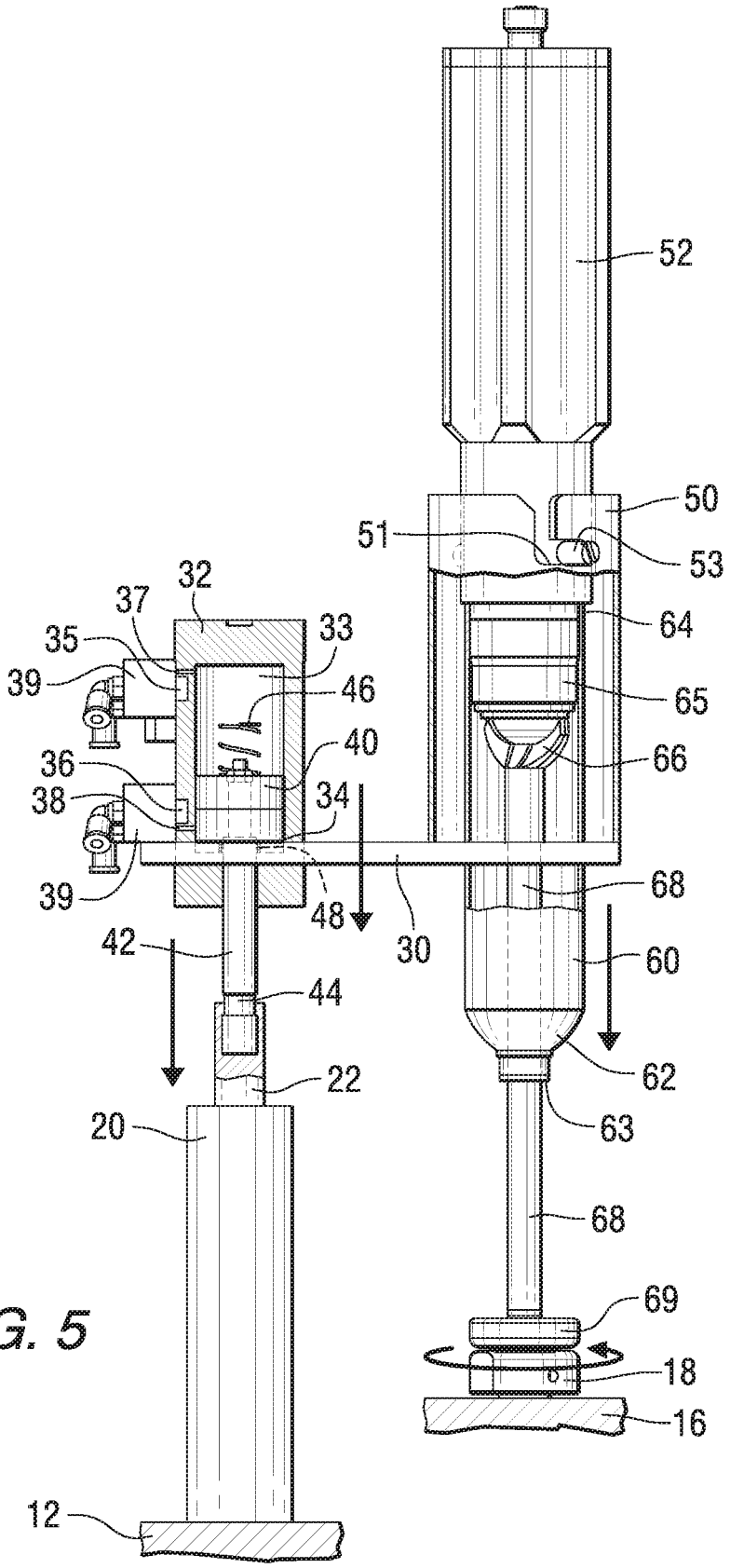
Figure 6:
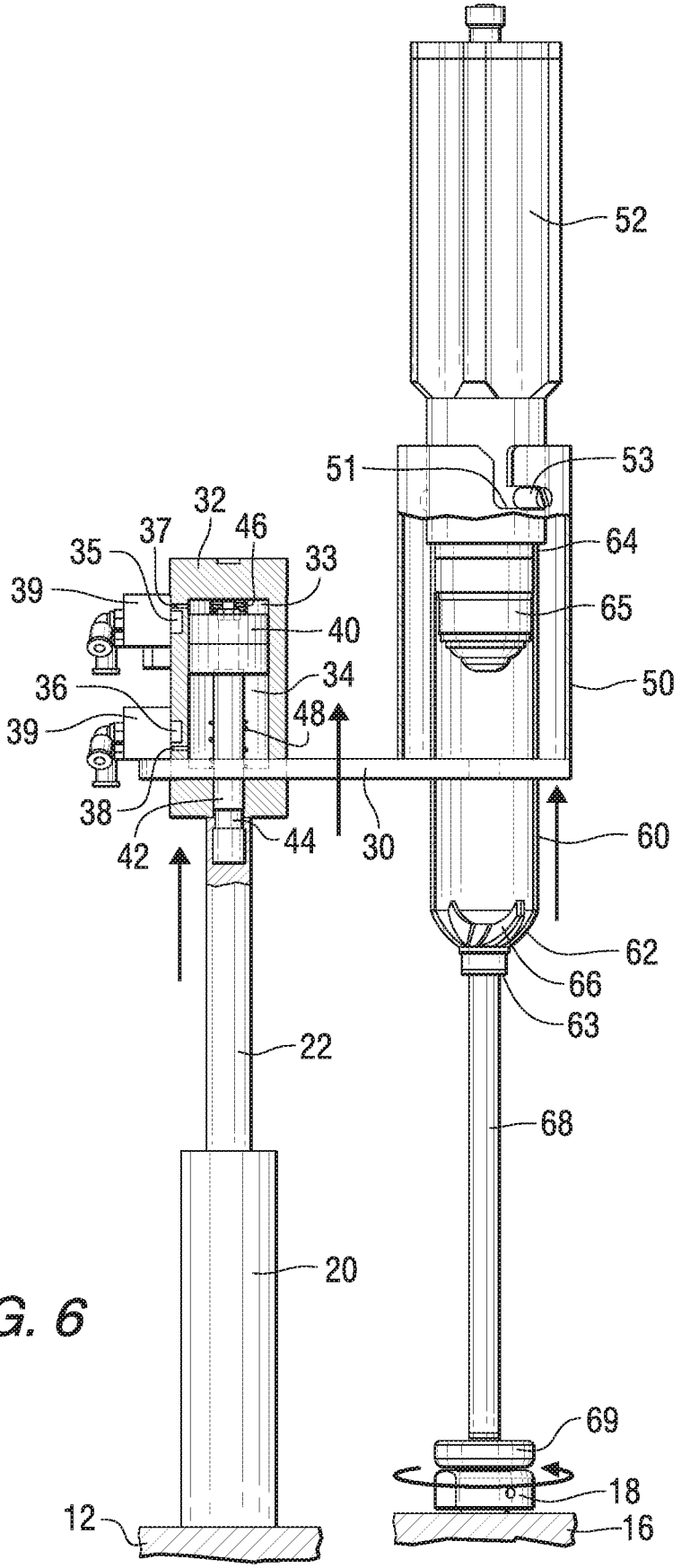

FIGS. 4-6 illustrate features of automatic stroke adjustment features in accordance with an embodiment of the present invention. The cartridge 60 is fixedly mounted in the cartridge holder sleeve 50 by means of the cartridge pusher 52. The pusher 52 is removably attached to the cartridge holder sleeve 50 by a bayonet mounting including slots 51 in the sleeve 50 and pins 53 secured to the cartridge pusher 52. Although one set of bayonet mounting slots 51 and pins 53 is visible in FIGS. 4-6, another bayonet mounting slot and pin may be provided 180° around the circumference of the cartridge holder sleeve 50.

As further shown in FIGS. 4-6, the adhesive/sealant cartridge 60 has a domed lower end 62 with a cartridge discharge opening 63. The cartridge 60 also has an open upper end 64 through which an upper plunger 65 is inserted inside the cartridge 60. The volume inside the cartridge 60 between the domed lower end 62 and upper plunger 65 defines a mixing volume inside the cartridge 60 that contains adhesive or sealant formulations that require mixing prior to their usage. As more fully described below, the adhesive and sealant compositions may comprise any formulations known to those skilled in the art. The dasher rod 68 extends through the cartridge discharge opening 63 into the mixing volume of the cartridge 60 and has a mixing impeller 66 mounted on a top end thereof.

In certain embodiments, the mixer 10 may be used to mix two components of adhesive or sealant formulations that are initially introduced into the cartridge 60. Mixing of the components in cartridge 60 is achieved by stroking the rotating dasher rod 68 and impeller 66 mounted thereon from one end of the cartridge 60 to the other. The dasher rod 68 is inserted in the cartridge 60 through the front or dispensing end 63 of the cartridge 60, and engages the impeller 66, which may be initially provided inside the cartridge 60 and may remain in the cartridge 60 after the mixing operation is completed. When mixing is completed, the dasher rod 68 may be disengaged from the impeller 66, and the dasher rod 68 may be removed through the dispensing end 63 of the cartridge 60.

The stroke distance inside the cartridge 60 is defined by the distance the impeller 66 moves between the lower end 62 and the upper plunger 65. Typical stroke distances may range from 2 to 8 inches, for example, from 3 to 6 inches, depending on the size of a particular cartridge.

As further shown in FIGS. 4-6, the lower end of the dasher rod 68 includes a lower spindle attachment disk 69 that is releasably attached to the rotatable spindle 18. As understood by those skilled in the art, one or more pins or other suitable types of attachment means may be used to secure the lower spindle attachment disk 69 against the upper face of the rotatable spindle 18 for rotation therewith.

Figure 7:
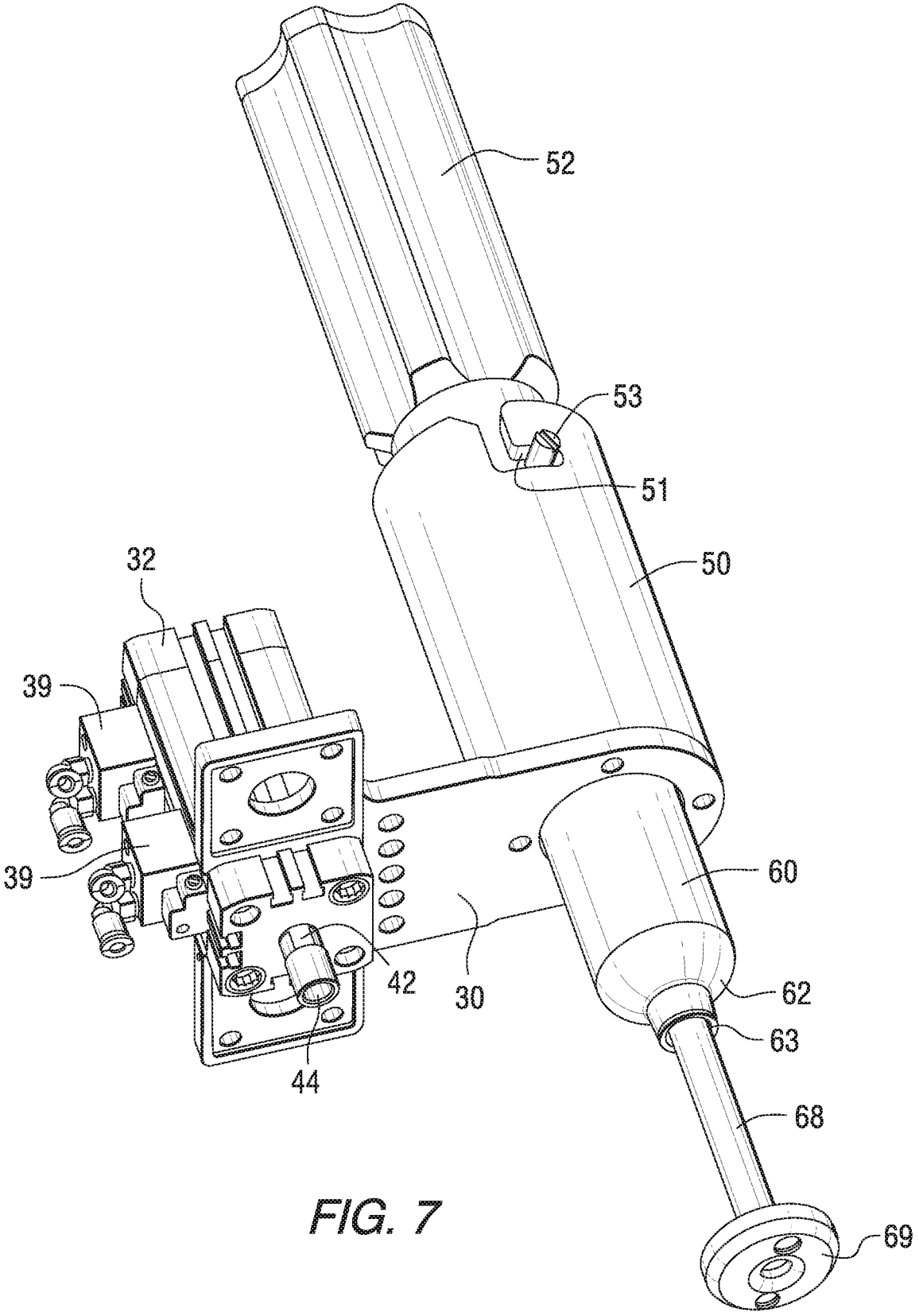
FIG. 7 is a bottom isometric view of a cartridge support plate, cartridge holder sleeve with a cartridge installed therein, and a pressure sensitive housing in accordance with an embodiment of the present invention.

FIG. 7 illustrates additional details of the bayonet mounting slot 51 and pin 53 arrangement for removably securing the cartridge pusher 52 in the upper portion of the cartridge holder sleeve 50. FIG. 7 also shows the bottom of the lower spindle attachment disk 69 with two holes therethrough that receive two upwardly extending pins (not shown) of known design mounted on the rotating spindle 18.

As shown in FIGS. 4-7, the pressure sensitive housing 32 is fixedly mounted on the cartridge support plate 30. An interior volume of the pressure sensitive housing 32 defines an upper piston chamber 33 and a lower piston chamber 34 separated by a piston 40. The piston 40 is connected to a piston rod 42, which is attached by means of the coupling 44 to the upper end of the reciprocating rod 22 of the main pressure cylinder 20. An upper compression spring 46 is provided above the piston 40 in the upper piston chamber 33. A lower compression spring 48 is provided below the piston 40 in the lower piston chamber 44. As more fully described below, as the piston 40 moves from an intermediate position as shown in FIG. 4 to a lowermost position as shown in FIG. 5 and an uppermost position as shown in FIG. 6, the compression springs 46 and 48 become alternatively compressed when the mixing impeller 66 contacts either the domed lower end 62 of the cartridge 60 or the upper plunger 65 within the cartridge 60. As an alternative to using spring force, pressurized air could be utilized acting as a resistance force in areas 33 and 34.

As further shown in FIGS. 4-6, an upper proximity sensor 35 is provided in the sidewall of the pressure sensitive housing 32 near the top wall of the upper piston chamber 33. A lower proximity sensor 36 is provided in the sidewall of the pressure sensitive housing 32 near the lower end wall of the lower piston chamber 34. The upper and lower proximity sensors 35 and 36 may be of any suitable design known to those skilled in the art. An optional upper pressurized air passage 37 passes through an upper portion of the pressure sensitive housing 32 in flow communication with the upper piston chamber 33. An optional lower pressurized air passage 38 passes through a lower portion of the pressure sensitive housing 32 in flow communication with the lower piston chamber 34. As shown in FIGS. 4-7, the upper and lower proximity sensors 35 and 36 and optional upper and lower pressurized air passages 37 and 38 are provided in upper and lower sensor and pressure fittings 39. The air passages 37 and 38 may be passively used, rather than actively used in certain embodiments.

In the intermediate position shown in FIG. 4, the mixing impeller 66 is forced through the adhesive or sealant formulation contained in the cartridge 60 through the relative vertical movement of the cartridge support plate 30, cartridge holder sleeve 50 and cartridge 60 in relation to the vertically stationary mixing impeller 66 and dasher rod 68. During such intermediate movement through the adhesive or sealant material, the resistive force applied by the adhesive or sealant material on the impeller 66 is less than the force necessary to compress the upper compression spring 46 or lower compression spring 48 by an appreciable amount. The piston 40 is thus held within the pressure sensitive housing 32 in a middle position axially away from the upper and lower proximity sensors 35 and 36 when the impeller 66 travels through the adhesive or sealant material.

However, when the mixing impeller 66 contacts the upper plunger 65 inside the cartridge 60 as shown in FIG. 5, further downward movement of the cartridge support plate 30 causes the lower compression spring 48 to compress in the region below the piston 40, thereby bringing the piston 40 next to the lower proximity sensor 36. As more fully described below, in this position, the lower proximity sensor 36 sends a signal to a controller 70 to stop the downward stroke of the reciprocating rod 22 and to reverse its direction.

As shown in FIG. 6, when the mixing impeller 66 contacts the domed lower end 62 of the cartridge 60, further upward movement of the cartridge support plate 30 causes the upper compression spring 46 to compress in the region above the piston 40 within the upper piston chamber 33. Such compression allows the piston 40 to travel close to the top end wall of the upper piston chamber 33 in a location next to the upper proximity sensor 35. In this position, a trigger signal is sent from the upper proximity sensor 35 to the controller 70 to stop the upward stroke of the reciprocating rod 22 and to reverse its direction. Air pressure may be switched by the controller 70 from the inlet 24 to the inlet 26 based on input from the pressure housing 32.

In the embodiment shown in FIGS. 4-6, the distance travelled by the piston 40 within the pressure housing 32 from the lower position shown in FIG. 5 to the upper position shown in FIG. 6 may typically be from 1 to 8 inches, for example, from 2 or 3 to 5 or 6 inches.

As shown in FIGS. 4-6, the upper and lower pressurized air passages 37 and 38 may optionally be included in the pressure sensitive housing 32 in order to pressurize the upper and lower piston chambers 33 and 34 to provide biasing force against the piston 40. Air pressure or alternatively hydraulic pressure supplied through the passages 37 and 38 may than be used to trigger the change in direction from the up stroke to the down stroke and vice versa. Pressure within the upper and lower piston chambers 33 and 34 may thus be used to counteract the force from the movement of the main stroke cylinder. The pressure and/or compression spring bias is overpowered when the stroke cylinder hits the ends of the cartridge being mixed, and this overpowering is sensed by the upper and lower proximity sensors 35 and 36. Thus, in addition to, or in place of, the upper and lower compression springs 46 and 48, pneumatic or hydraulic pressure may be provided in the pressure sensitive housing 32 through the passages 37 and 38.

Automatic stroke adjustment is based on sensing force that the main pressure cylinder 20 generates in the direction of the stroke and then switches the direction when the force needs spiked up when the stroke reaches a physical limit in the cartridge assembly. The mixer automatically detects the size of a cartridge by using the internal cartridge resistance encountered when the dasher rod and impeller travels up and down inside the cartridge and touches the lower dome side of the cartridge and when it touches the upper plunger. The sensing of the force can be done by using springs, air pressure or pneumatically, hydraulically electronically or by any other suitable sensing means.

The adhesive and sealant formulations contained in the cartridge 60 may comprise a two-component ("2K") composition. As used herein, a "two-component composition" (or "2K composition") refers to an adhesive or sealant composition in which at least a portion of the reactive components readily react and cure without activation from an external energy source, such as at ambient or slightly thermal conditions, when mixed. One skilled in the art understands that the two components of the adhesive or sealant composition are stored separately from each other and mixed just prior to application of the composition.

The first component of the 2K composition may comprise one or more epoxy-containing compounds, such as epoxies, polysulfides, polythioethers and the like. The adhesive or sealant composition further comprises a second component that chemically reacts with the first component, such as manganese dioxide, dichromate polysulfide, epoxy and the like. As used herein, the term "cure", "cured" or similar terms, as used in connection with the adhesive composition described herein, means that at least a portion of the components that form the adhesive or sealant composition are crosslinked to form an adhesive layer or bond. The second component may be referred to as a curing agent, hardener and/or cross-linker.

Figure 8:
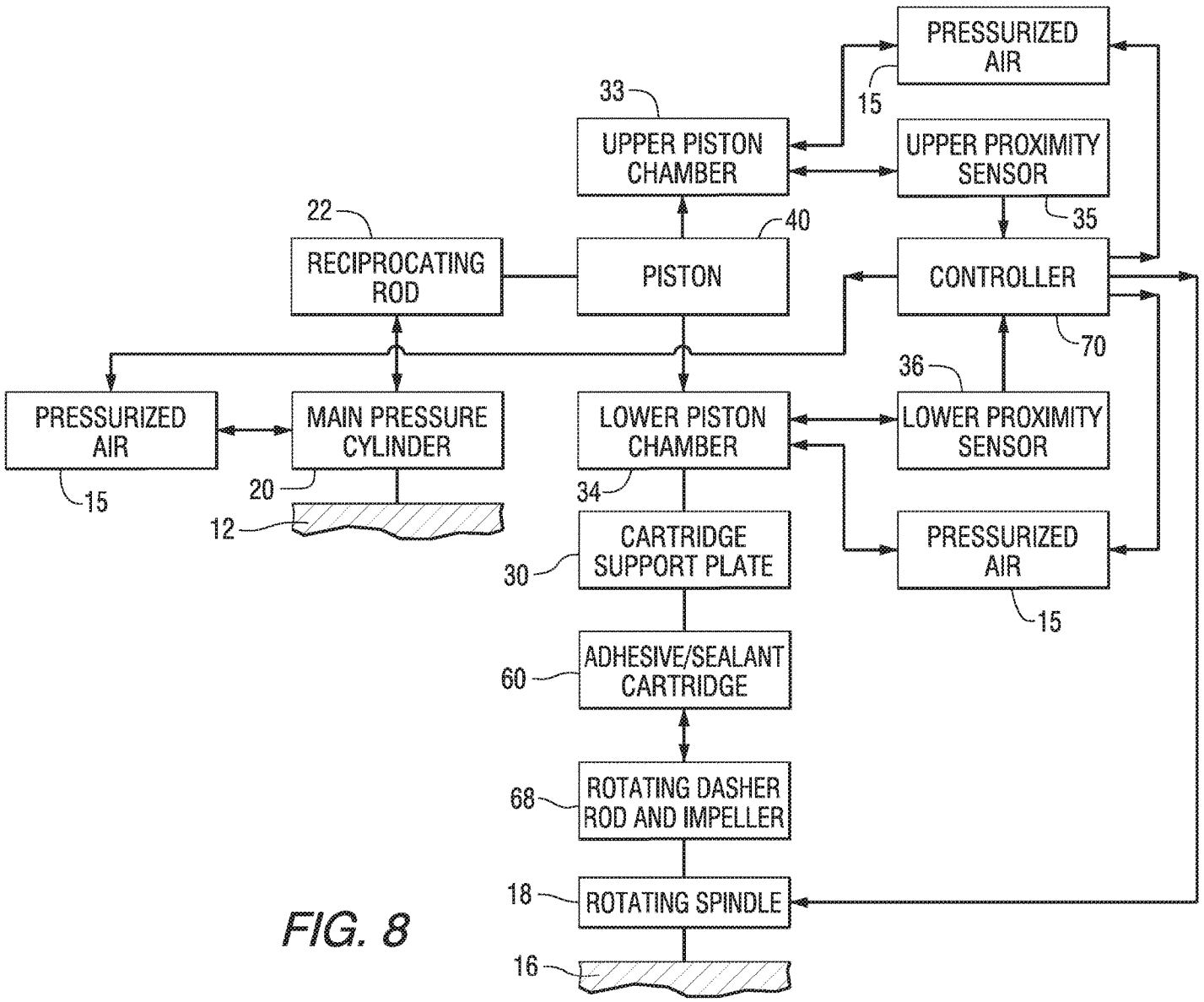
FIG. 8 is a schematic diagram illustrating structural components and operational features of an adhesive and sealant mixture with automatic stroke length adjustment in accordance with an embodiment of the present invention.

FIG. 8 is a flow diagram schematically illustrating operational features of a mixer in accordance with an embodiment of the present invention. As described above, the main pressure cylinder 20 is fixedly attached to the base 12 with the reciprocating rod 22 extending upward therefrom. The rotating spindle 18 is supported by the platform 16 and engages the bottom of the rotating dasher rod having the impeller attached at a top end thereof. As further illustrated in FIG. 8, the rotating dasher rod 68 extends into the adhesive/sealant cartridge, which is mounted on the cartridge support plate 30 by means of the cartridge holder sleeve. The piston 40 reciprocatingly moves inside the lower piston chamber 34 and upper piston chamber 33 of the pressure sensitive housing. The upper and lower proximity sensors 35 and 36 are used to detect when the piston 40 is located at the top of the upper piston chamber 33 or at the bottom of the lower piston chamber 34.

As further shown in FIG. 8, pressurized air 15 is selectively fed to the main pressure cylinder 20 to move the reciprocating rod 22 upward or downward which, acting through the piston 40 and upper and lower piston chambers 33 and 34, results in upward or downward movement of the cartridge support plate 30. In certain embodiments, pressurized air 15 may also optionally be fed into the upper piston chamber 33 (by means of the upper pressurized air passage 37) and the lower piston chamber 34 (by means of the lower pressurized air passage 38). Although a single source of pressurized air 15 is illustrated in FIG. 8, it is to be understood that the source or sources of pressurized air may be configured in any suitable manner in order to provide desired air pressure levels and sequencing to the main pressure cylinder 20, and desired pressure levels and sequencing to the upper and lower piston chambers 33 and 34.

As further shown in FIG. 8, a controller 70 receives signals from the upper and lower proximity sensors 35 and 36. The controller 70 communicates with the pressurized air assembly 15 that feeds the main pressure cylinder 20, and with the pressurized air sources 15 that optionally feed the upper and lower piston chambers 33 and 34. The controller 70 also communicates with the rotating spindle 18. Conventional machine logic may be used to sequence the machine movements based on inputs from the internal pressure sensing signals. The logic can be implemented with pneumatic or electronic circuits, or a combination of the two. For example, pneumatic logic may be used to control the actuators for introducing pressurized air either through the lower pressurize air inlet 24 or the upper pressurize air inlet 26 of the main pressure cylinder 20, the rotating spindle 18, and optional air pressure introduced into the pressure sensitive housing 32.

For the controller 70 or any other element expressed herein as a means for performing a specified function, such element is intended to encompass any way of performing that function including, for example, a combination of elements that performs that function. Furthermore, the invention, as may be defined by such means-plus-function claims, resides in the fact that the functionalities provided by the various recited means are combined and brought together in a manner as defined by the appended claims. Therefore, any means that can provide such functionalities may be considered equivalents to the means shown herein.

In various embodiments, various models or platforms can be used to practice certain aspects of the invention. For example, software-as-a-service (SaaS) models or application service provider (ASP) models may be employed as software application delivery models to communicate software applications to users. Such software applications can be downloaded through an Internet connection, for example, and operated either independently (e.g., downloaded to a laptop or desktop computer system) or through a third-party service provider (e.g., accessed through a third-party web site). In addition, cloud computing techniques may be employed in connection with various embodiments of the invention.

Moreover, the processes associated with the present embodiments may be executed by programmable equipment, such as computers. Software or other sets of instructions that may be employed to cause programmable equipment to execute the processes may be stored in any storage device, such as a computer system (non-volatile) memory. Furthermore, some of the processes may be programmed when the computer system is manufactured or via a computer-readable memory storage medium.

It can also be appreciated that certain process aspects described herein may be performed using instructions stored on a computer-readable memory medium or media that direct a computer or computer system to perform process steps. A computer-readable medium may include, for example, memory devices such as diskettes, compact discs of both read-only and read/write varieties, optical disk drives, and hard disk drives. A computer-readable medium may also include memory storage that may be physical, virtual, permanent, temporary, semi-permanent and/or semi-temporary. Memory and/or storage components may be implemented using any computer-readable media capable of storing data such as volatile or non-volatile memory, removable or non-removable memory, erasable or non-erasable memory, writeable or re-writeable memory, and so forth.

A "computer," "computer system," "computing apparatus," "component," or "computer processor" may be, for example and without limitation, a processor, microcomputer, minicomputer, server, mainframe, laptop, personal data assistant (PDA), wireless e-mail device, smart phone, mobile phone, electronic tablet, cellular phone, pager, fax machine, scanner, or any other programmable device or computer apparatus configured to transmit, process, and/or receive data. Computer systems and computer-based devices disclosed herein may include memory and/or storage components for storing certain software applications used in obtaining, processing, and communicating information. It can be appreciated that such memory may be internal or external with respect to operation of the disclosed embodiments. In various embodiments, a "host," "engine," "loader," "filter," "platform," or "component" may include various computers or computer systems, or may include a reasonable combination of software, firmware, and/or hardware. In certain embodiments, a "module" may include software, firmware, hardware, or any reasonable combination thereof.

In general, it will be apparent to one of ordinary skill in the art that various embodiments described herein, or components or parts thereof, may be implemented in many different embodiments of software, firmware, and/or hardware, or modules thereof. The software code or specialized control hardware used to implement some of the present embodiments is not limiting of the present invention. Programming languages for computer software and other computer-implemented instructions may be translated into machine language by a compiler or an assembler before execution and/or may be translated directly at run time by an interpreter. Such software may be stored on any type of suitable computer-readable medium or media such as, for example, a magnetic or optical storage medium. Thus, the operation and behavior of the embodiments are described without specific reference to the actual software code or specialized hardware components. The absence of such specific references is feasible because it is clearly understood that artisans of ordinary skill would be able to design software and control hardware to implement the embodiments of the present invention based on the description herein with only a reasonable effort and without undue experimentation.

Various embodiments of the systems and methods described herein may employ one or more electronic computer networks to promote communication among different components, transfer data, or to share resources and information. Such computer networks can be classified according to the hardware and software technology that is used to interconnect the devices in the network, such as optical fiber, Ethernet, wireless LAN, HomePNA, power line communication or G.hn.

The computer network may be characterized based on functional relationships among the elements or components of the network, such as active networking, client-server, or peer-to-peer functional architecture. The computer network may be classified according to network topology, such as bus network, star network, ring network, mesh network, star-bus network, or hierarchical topology network, for example. The computer network may also be classified based on the method employed for data communication, such as digital and analog networks.

As employed herein, an application server may be a server that hosts an API to expose business logic and business processes for use by other applications. The application servers may mainly serve web-based applications, while other servers can perform as session initiation protocol servers, for instance, or work with telephony networks.

Although some embodiments may be illustrated and described as comprising functional components, software, engines, and/or modules performing various operations, it can be appreciated that such components or modules may be implemented by one or more hardware components, software components, and/or combination thereof.

The flow charts and methods described herein show the functionality and operation of various implementations. If embodied in software, each block, step, or action may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processing component in a computer system. If embodied in hardware, each block may represent a circuit or a number of interconnected circuits to implement the specified logical function(s).

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

For purposes of the description above, it is to be understood that the invention may assume various alternative variations and step sequences except where expressly specified to the contrary. Moreover, other than in any operating examples, or where otherwise indicated, all numbers expressing, for example, quantities of ingredients used in the specification and claims, are to be understood as being modified in all instances by the term "about". Accordingly, unless indicated to the contrary, the numerical parameters set forth are approximations that may vary depending upon the desired properties to be obtained by the present invention. At the very least, and not as an attempt to limit the application of the doctrine of equivalents, each numerical parameter should at least be construed in light of the number of reported significant digits and by applying ordinary rounding techniques.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application, the articles "a," "an," and "the" include plural referents unless expressly and unequivocally limited to one referent.

The automatic stroke length adjustment provided by the present invention reduces or eliminates operator mistakes, because the mixer automatically goes to the ends of the cartridges consistently and reliably. Quality concerns in airframe product lines may therefore be addressed where sealant application and mix ratios are critical issues.

Whereas particular embodiments of this invention have been described above for purposes of illustration, it will be evident to those skilled in the art that numerous variations of the details of the present invention may be made without departing from the invention as defined in the appended claims.

What is claimed is:

1. A mixer for adhesives or sealants comprising:

a cartridge support plate;

a cartridge holder sleeve mounted on the cartridge support plate structured and arranged to receive at least a portion of an adhesive or sealant cartridge therein;

a pressure sensitive housing mounted on the cartridge support plate;

a piston reciprocatingly movable within the pressure sensitive housing defining an upper piston chamber and a lower piston chamber within the pressure sensitive housing;

an upper biasing element in the upper piston chamber;

a lower biasing element in the lower piston chamber;

at least one proximity sensor mounted on the pressure sensitive housing structured and arranged to sense a position of the piston within the pressure sensitive housing;

a piston rod connected to the piston and extendable from the pressure sensitive housing; and a main pressure cylinder comprising a reciprocating rod extendable therefrom connected to the piston rod, wherein upward movement of the reciprocating rod causes the piston to move toward an upper end wall of the upper piston chamber against force applied to the piston by the upper biasing element, and downward movement of the reciprocating rod causes the piston to move toward a lower end wall of the lower piston chamber against force applied to the piston by the lower biasing element.

2. The mixer of claim 1, wherein the upper biasing element comprises an upper compression spring and the lower biasing element comprises a lower compression spring.

3. The mixer of claim 1, wherein the upper biasing element comprises pressurized fluid that is selectively introduced into the upper piston chamber, and the lower biasing element comprises pressurized fluid that is selectively introduced into the lower piston chamber.

4. The mixer of claim 3, wherein the pressurized fluid is air.

5. The mixer of claim 1, further comprising an adhesive or sealant cartridge mounted in the cartridge holder, wherein the cartridge comprises:

a lower end with a discharge opening therethrough;

an upper open end;

an upper plunger inserted in the cartridge through the upper open end;

a rotatable dasher rod slidably extendable through the discharge opening;

a mixing impeller attached to an upper end of the rotatable dasher rod;

a spindle attachment disk attached to a lower end of the rotatable dasher rod; and an adhesive or sealant material at least partially filling a mixing volume inside the cartridge between the lower end and the upper plunger.

6. The mixer of claim 5, wherein the upper biasing element comprises an upper compression spring and the lower biasing element comprises a lower compression spring, and each of the upper and lower compression springs do not substantially compress when the mixing impeller passes through the adhesive or sealant material inside the cartridge.

7. The mixer of claim 6, wherein the lower compression spring compresses upon contact between the mixing impeller and the upper plunger, and the upper compression spring compresses upon contact between the mixing impeller and the lower end of the cartridge.

8. The mixer of claim 5, wherein the mixer further comprises a rotatable spindle to which the spindle attachment disk of the dasher rod is releasably secured, and wherein:

rotation of the rotatable spindle causes rotation of the dasher rod; and reciprocating movement of the reciprocating rod in relation to the main cylinder cases the pressure sensitive housing, cartridge support plate, cartridge holder sleeve and cartridge to move vertically in relation to the rotatable spindle, dasher rod and mixing impeller to thereby stroke the mixing impeller through the adhesive or sealant material contained in the cartridge.

9. The mixer of claim 8, wherein, when the mixer impeller contacts the upper plunger, the piston is forced downward in the pressure sensitive housing against biasing force provided by the lower biasing element and, when the mixing impeller contacts the lower end of the cartridge, the piston is forced upward in the pressure sensitive housing against biasing force provided by the upper biasing element.

10. The mixer of claim 9, wherein the at least one proximity sensor comprises:

an upper proximity sensor mounted adjacent an upper end wall of the upper piston chamber; and a lower proximity sensor mounted adjacent a lower end wall of the lower piston chamber, and wherein the upper proximity sensor detects the piston when the piston moves upward against the upper biasing element upon contact of the mixing impeller with the lower end of the cartridge, and the lower proximity sensor detects the piston when the piston moves downward against the lower biasing element upon contact of the mixing impeller with the upper plunger.

11. An adhesive or sealant mixing assembly comprising:

a cartridge support plate;

an adhesive sealant cartridge mounted on the cartridge support plate;

a pressure sensitive housing connected to the cartridge support plate;

a piston reciprocatingly movable within the pressure sensitive housing defining an upper piston chamber and a lower piston chamber within the pressure sensitive housing;

an upper biasing element in the upper piston chamber;

a lower biasing element in the lower piston chamber;

at least one proximity sensor mounted on the pressure sensitive housing structured and arranged to sense a position of the piston within the pressure sensitive housing;

a piston rod connected to the piston and extendable from the pressure sensitive housing;

a main pressure cylinder comprising a reciprocating rod extendable therefrom connected to the piston rod, wherein upward movement of the reciprocating rod causes the piston to move toward an upper end wall of the upper piston chamber against force applied to the piston by the upper biasing element, and downward movement of the reciprocating rod causes the piston to move toward a lower end wall of the lower piston chamber against force applied to the piston by the lower biasing element, and wherein the adhesive or sealant cartridge comprises:

a lower end with a discharge opening therethrough;

an upper open end;

an upper plunger inserted in the cartridge through the upper open end;

a rotatable dasher rod slidably extendable through the discharge opening;

a mixing impeller attached to an upper end of the rotatable dasher rod;

a spindle attachment disk attached to a lower end of the rotatable dasher rod; and an adhesive or sealant material at least partially filling a mixing volume inside the cartridge between the lower end and the upper plunger.

12. A pressure sensitive position sensing system for use with an adhesive or sealant cartridge mixer comprising:

a pressure sensitive housing mounted on a cartridge support plate;

a piston reciprocatingly movable within the pressure sensitive housing defining an upper piston chamber and a lower piston chamber within the pressure sensitive housing;

an upper biasing element in the upper piston chamber;

a lower biasing element in the lower piston chamber;

at least one proximity sensor mounted on the pressure sensitive housing structured and arranged to sense a position of the piston within the pressure sensitive housing;

a piston rod connected to the piston and extendable from the pressure sensitive housing; and a main pressure cylinder comprising a reciprocating rod extendable therefrom connected to the piston rod, wherein upward movement of the reciprocating rod causes the piston to move toward an upper end wall of the upper piston chamber against force applied to the piston by the upper biasing element, and downward movement of the reciprocating rod causes the piston to move toward a lower end wall of the lower piston chamber against force applied to the piston by the lower biasing element.

13. The pressure sensitive position sensing system of claim 12, wherein the upper biasing element comprises an upper compression spring and the lower biasing element comprises a lower compression spring.

14. The pressure sensitive position sensing system of claim 12, wherein the main pressure cylinder comprises:

a lower pressurized air inlet for introducing pressurized air into the main pressure cylinder to force the piston rod upward; and an upper pressurized air inlet for introducing pressurized air into the main pressure cylinder to force the piston rod downward.

15. The pressure sensitive position sensing system of claim 14, further comprising a controller for selectively introducing the pressurized air through the lower pressurized air inlet or through the upper pressurized air inlet.

* * * * *